US005441175A

United States Patent [19]

Jacobsen et al.

[11] Patent Number: 5,441,175

[45] Date of Patent: Aug. 15, 1995

[54] UNIVERSAL TOOL FOR TWIN CARTRIDGE MATERIAL SYSTEMS

[76] Inventors: Kenneth H. Jacobsen, 921 N. Quentin Rd., Palatine, Ill. 60067; Louis F. Cole, 672 Constitution Dr., Unit 93-5, Palatine, Ill. 60074

[21] Appl. No.: 248,060

[22] Filed: May 23, 1994

[51] Int. Cl.[6] ..... B67D 5/52

[52] U.S. Cl. ..... 222/137; 222/334; 222/327

[58] Field of Search ..... 222/137, 145, 459, 326, 222/327, 391, 334

[56] References Cited

U.S. PATENT DOCUMENTS

| | | | |
|---|---|---|---|
| 5,224,628 | 7/1993 | Keller | 222/137 |
| 5,228,599 | 7/1993 | Keller | 222/317 X |
| 5,263,614 | 11/1993 | Jacobsen et al. | 222/137 |
| 5,314,092 | 5/1994 | Jacobsen et al. | 222/137 |
| 5,330,079 | 7/1994 | Keller | 222/137 X |

*Primary Examiner*—Gregory L. Huson
*Attorney, Agent, or Firm*—Charles F. Lind

[57] ABSTRACT

The disclosed universal tool has a front plate with an open ended slot extended from near the front wall center, with the front wall defining the slot having one thickness and the wall spaced from the slot having a greater thickness. The front wall further can be mounted in the tool in two different arrangements, respectively flipped over 180 degrees. This tool thereby accommodates different paired material cartridges, both as to size to give different component ratios and as to constructions, such as from different manufactures. The cartridges further can be shifted along the slot as needed to remain parallel to the plunger rods that drive plungers through the cartridges to cause material discharge therefrom. The stable front wall-cartridge cooperation also holds the cartridge and easily allows rearward plunger withdrawl from the emptied cartridge. Also, centered and offset plunger mounts are provided for the plunger rods to allow different cartridges to fit and work in the tool, without changing the center spacing of the plunger rods.

6 Claims, 5 Drawing Sheets

UNIVERSAL TOOL FOR TWIN CARTRIDGE MATERIAL SYSTEMS

RELATED APPLICATION

This application is filed as an improvement and/or modification of our application filed Feb. 5, 1993 Ser. No. 08/014,114, and entitled MATERIAL DISPENSING TOOL AND PLUNGER FOR CYLINDRICAL CARTRIDGES, which issued as U.S. Pat. No. 5,314,092 on May 24, 1994; which application was filed as an improvement and/or modification of our application filed May 14, 1992 having Ser. No. 07/882,836, and entitled MATERIAL DISPENSING TOOL FOR TUBULAR CARTRIDGES, which issued as U.S. Pat. No. 5,263,614 on Nov. 23, 1993.

1. Field of the Invention

This invention relates to a tool for dispensing substantially incompressible pasty material contained in cartidges, and particularly to a tool of the type for simultaneously discharging different reactive components from different cartridges for yielding a blended discharge of a specially formulated composite material.

2. Background of the Invention

Caulk, adhesive, potting material and other fluids are commonly contained in tubular cartridges of the type having a closure wall and nozzle at one end and an opposite open end that is closed by a wiper slidably seated against the inside of the cartridge. Dispensing tools are available to hold these cartridges, and to move a plunger axially of and into the open cartridge end and against the wiper, for discharging the contained material from the open nozzle. Available dispensing tools can be powered, such as pneumatically or manually.

Most dispensing tools utilize a plunger rod driven by a power device, such as a piston powered in a cylinder of a pneumatic tool or a ratchet mechanism of a manual tool, each being advanced through the cartridge by squeezing a trigger. The force and displacement of the pneumatic and manual tools differ: being large and continuous in the pneumatic tool, lasting as long as the trigger is being squeezed; and being small and incremental in the manual tool, with and upon each trigger squeeze. Different ratio manual ratchet mechanisms can be used to generate greater indexing forces, but as indexed distances and generated forces are inversely related, additional trigger squeezes will be needed to provide any intended material discharge. Manual tools generally cost less and have greater portability, compared to pneumatic tools, and thus remain in strong demand.

Moreover, most cartridge-contained materials are substantially incompressible liquids or pastes having poor flow characteristics and/or high viscosities, and frequently must be discharged against a significant back pressure. Thus, large axial plunger forces are required to advance the plunger through the cartridge. The user's needed strength and fatigue experienced, and the poor continuity or pulsed material discharge between each trigger squeeze, remain major shortcomings of the manual tools. The plunger advance further must correspond exactly to the needed rate of material discharge, which could require extending each squeezing stroke over a longer duration than a more normal quick easy squeeze of a second or so, thereby quickly causing user fatigue.

Further, composite materials having very desirable physical properties can be formed by blending together reactive materials according to precise proportions. Several common examples of these multiple component reactive materials include two-part epoxies, urethanes, silicones, phenolics, acrylics and polyesters. Existing dispensing tools for such multiple component material systems utilize a separate cartridge for containing each component, and force all component discharges through a single mixing nozzle for yielding a single combined material discharge. The separate cartridges are held in generally adjacent side-by-side relationship, and separate plungers are advanced in unison through the respective cartridges. As the components and their ratios can be varied to yield different composite materials, component cartridges are available in different sizes and diameters.

The forced blending of the components before discharge increases the needed static pressures and plunger forces, as does the possible use of large diameter cartridges for yielding large volumetric capacities and/or specific component ratios. Any variation from precisely matched advances of the paired plungers could modify the desired component ratios and adversely change the expected physical properties of the resulting material. Pulsed material discharges also disrupt proper component mixing and/or proportioning, producing inconsistent material discharge possibly having inferior physical properties.

Our above-mentioned U.S. Pat. No. 5,263,614 is directed to manual dispensing tools having spring linkage between the power device and driven plunger(s) for storing and dissipating unused energy inputted to the power device, thereby maintaining substantially continuous forces on the plunger(s) even between successive trigger squeezes. This invention minimizes the above mentioned problems of user fatigue or needed strength, and poor continuity and/or mixing of material due to pulsed discharge with each trigger squeeze, and is particularly suited for use with multiple component fluid systems.

Our above-mentioned U.S. Pat. No. 5,314,092 is directed to dispensing tools having a special sealing plunger for precluding material seepage past the cartridge wiper from leaking from the cartridge itself. The patent further is directed to multiple component fluid systems dispensing tools having the side-by-side tangentially-arranged material cartridges and the axially aligned plunger rods, with a common drive rod lying on the plane through the plunger rods and telescoping into the open rear end of one of the cartridges as the components are being dispensed from the cartridges.

SUMMARY OF THE INVENTION

This invention relates to material dispensing tools for use with multiple component fluid systems having side-by-side tangentially-arranged component cartridges.

A basic object of this invention is to provide a dispensing tool having strong universal acceptance in that it works easily with most commercially available desired component cartridges, which can differ in many ways including the sizes (such as to yield different component ratios for formulating specific intended composite materials or to yield different volume needs), and the shapes (such as cartridges made by different suppliers).

Another object of this invention is to provide a dispensing tool having structure that traps and holds the component cartridges in place in the tool while discharging the material therefrom and otherwise, yielding greater tool reliability and stability. A related object of this invention is to provide a dispensing tool that is generally smaller than other conventional tools for the same purpose, being thereby generally more economical and possibly lighter by comparison.

A specific feature of this invention is a tool front plate suited to cooperate with side-by-side component cartridges of a reactive multiple component material system, to receive and hold such cartridges in good axial alignment with the driven plunger rods, even should such cartridges be of different sizes and/or ratios, and without requiring any adjustment of the spacing between the plunger rods. The tool front plate further can be positioned in either of two operative positions in the tool, for receiving cartridge nozzles of different cartridge shapes, such as from different suppliers. The tool front plate and cartridges cooperate further to hold the cartridges in the tool as the plungers are rearwardly withdrawn from the empty cartridges.

BRIEF DESCRIPTION OF THE DRAWINGS

Further objects, advantages and features of the present invention will appear from the following disclosure and description, including as a part thereof the accompanying drawing, in which.

DETAILED DESCRIPTION OF ILLUSTRATED EMBODIMENTS

Figure 1:
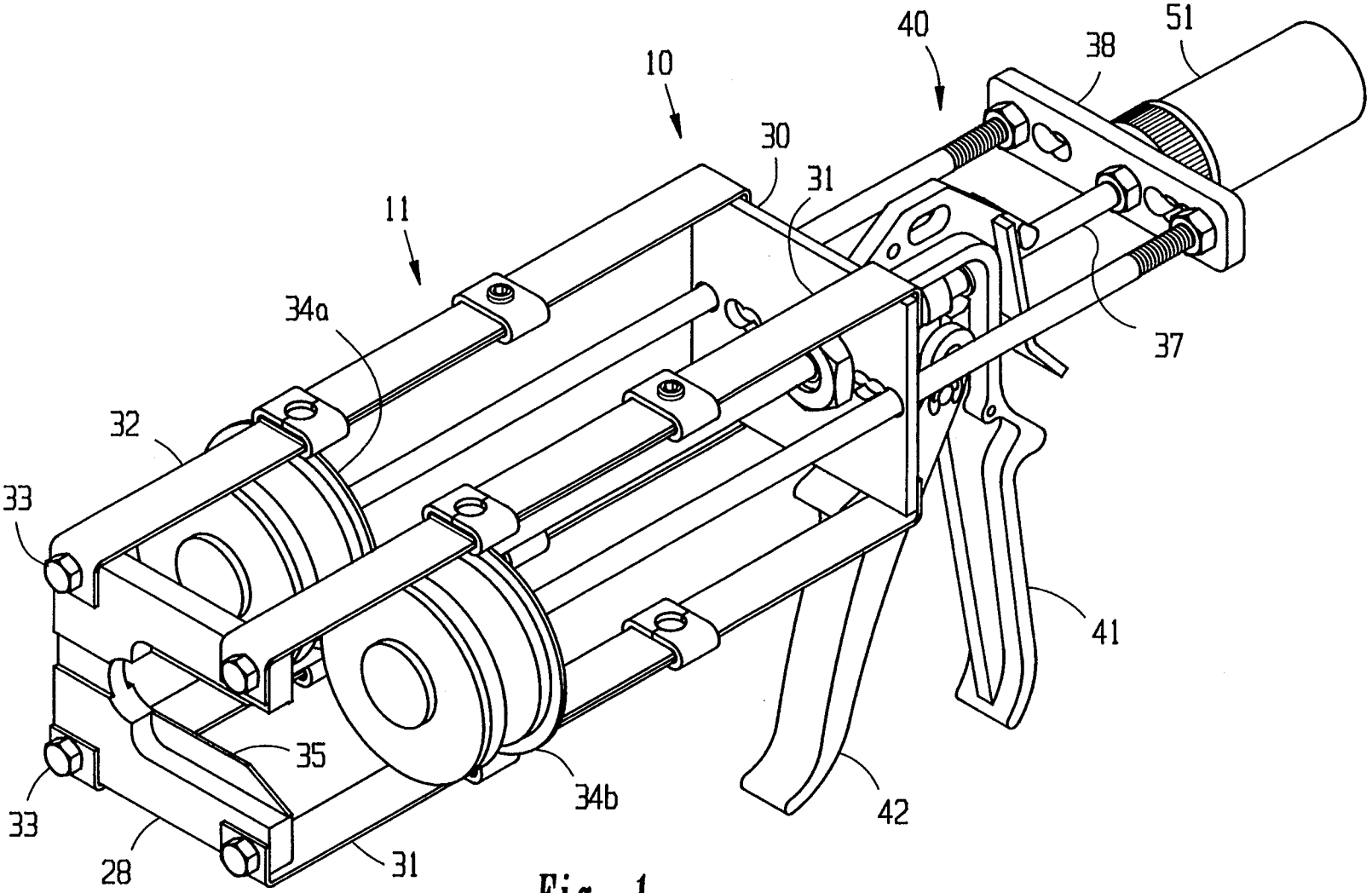
FIG. 1 is a frontal prespective view of a first dispensing tool with a front plate illustrated in a first operative position.
Figure 2:
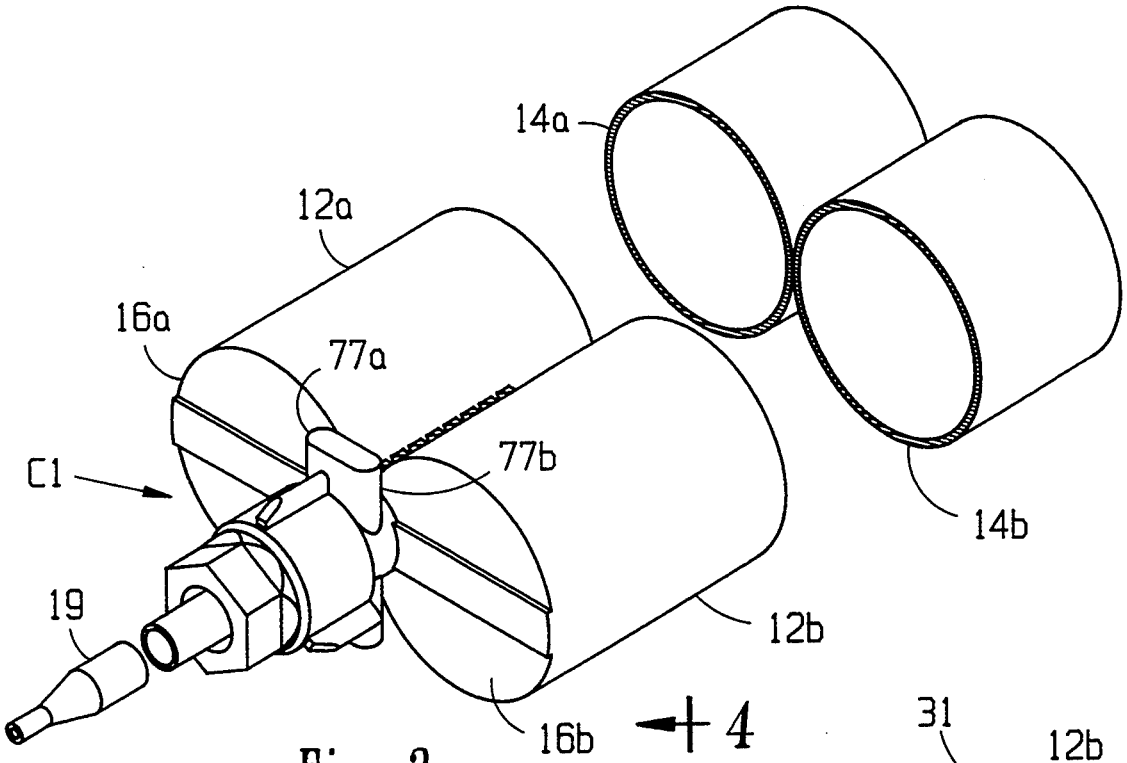
FIG. 2 is a frontal prespective view, shown in the same manner as FIG. 1, of first conventional component cartridges that can advantageously be used with the dispensing tool of FIG. 1.
Figure 3:
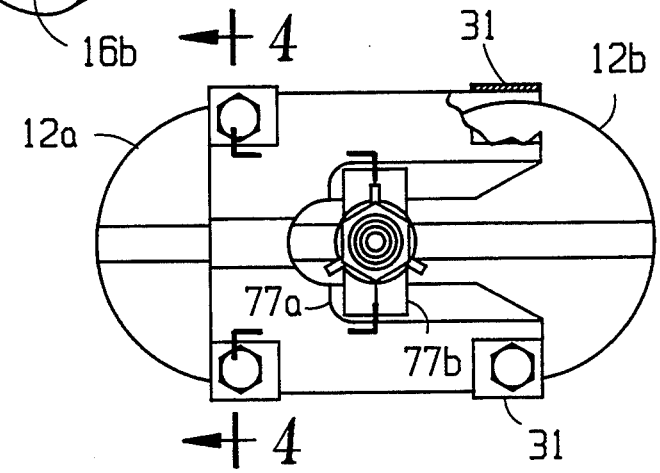
FIG. 3 is a front elevational view of the tool and cartridges of FIGS. 1 and 2 respectively, shown operatively assemblied together.
Figure 4:
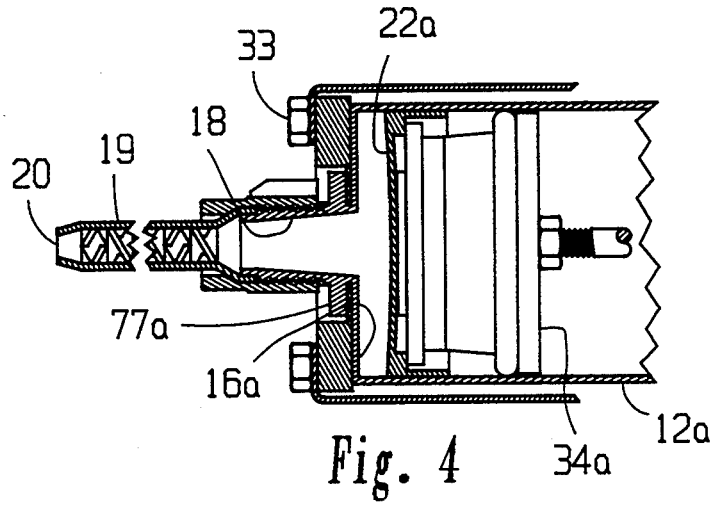
FIG. 4 is a section view of the assemblied tool and cartridges, taken somewhat from line 4—4 in FIG. 3.

The teachings of our above-mentioned U.S. Pat. Nos. 5,263,614 and 5,314,092 are incorporated by reference herein, to illustrate in greater detail the actual constructions not shown in this disclosure.

Two basic dispensing tools 10 and 510 are illustrated herein, tool 10 being manually and tool 510 being pneumatically powered. Each thus has a cartridge holding frame 11 which in almost all respects can be identical to one another, and a respective manual power device 40 and pneumatic power device 540. Each cartridge frame 11 is designed to hold two paired component cartridges and guide a plunger into each respective cartridge for discharging the contained material as needed. The paired cartridges contain different reactive components, individually stable when separate, which when mixed together form a different final composite material.

Figure 5:
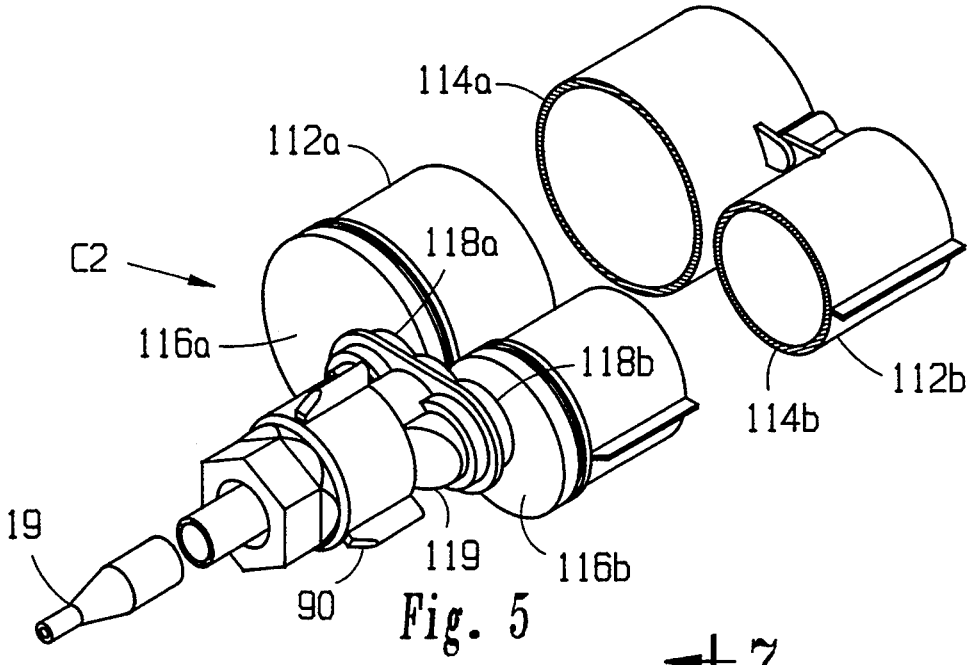
FIG. 5 is a frontal prespective view, shown in the same manner as FIG. 2, of second conventional component cartridges that can advantageously be used with the dispensing tool of FIG. 1, except modified to have different plungers and to have the front plate shifted to a second operative position.
Figure 6:
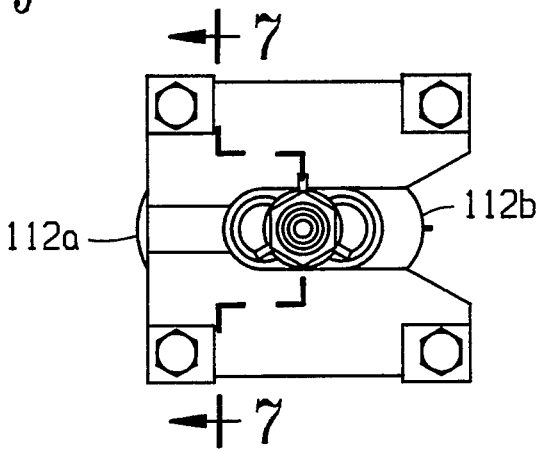
FIGS. 6 and 7 are views corresponding to FIGS. 3 and 4, except with the cartridges of FIG. 5 shown operatively assemblied together in the modified tool.
Figure 7:
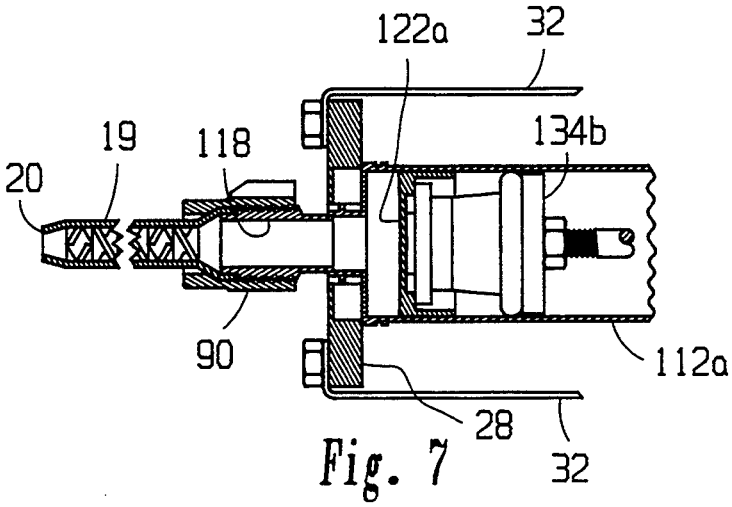

Two types of conventional cartridges C1 and C2 are illustrated, and differ in the manner of securing the paired cartridges together and in the dispensing nozzles arrangements. Each type of conventional paired cartridges C1 and C2 can differ in size and ratio, so that they are identified differently as 12*a*, 12*b* in FIGS. 2–4 and 9*a*, as 112*a*, 112*b* in FIGS. 5–7, as 212*a*, 212*b* in FIG. 9*b*, and as 312*a*, 312*b* in FIG. 9*c*. However, each paired cartridges 12*a*, 12*b*; 112*a*, 112*b*; 212*a*, 212*b*; and 312*a*, 312*b* would have common or related features, which may not be identified in every drawing.

As itemized herein, the paired cartridges 12*a*, 12*b* and 112*a*, 112*b* have tubular body wall 14*a*, 14*b* or 114*a*, 114*b* with closure wall 16*a*, 16*b* or 116*a*, 116*b*, and tubular nozzle structure 18 or 118 (FIGS. 4 and 7) at one end and an open opposite end closed by wiper 22*a* or 122*a* seated against and axially slidable along the inside face of the cartridge wall. The paired cartridges would be disposed side-by-side with outlets near the adjacent tangential edges of the cartridges to discharge the reactive components from the cartridges through a single mixing tube 19 for discharge then as the composite new material from a single outlet nozzle 20.

Each cartridge holding frame 11 can be similar, having a front wall 28 and a rear wall 30, 530 and spaced axial strap members 31, 32 connected rigidly between these walls, as by bolts 33. The cartridge holding frame members 28, 30, 31 and 32 are separated sufficiently to allow the component cartridges to be positioned therebetween. Thus, the front and rear walls 28 and 30 are spaced apart by a distance slightly exceeding the length of the cartridges, and the two strap members 31, and the two strap members 32 are separated by a distance slightly exceeding the diameter of the largest cartridge to be used in the tool.

Tool plungers 34*a*, 34*b* or 134*a*, 134*b* are carried on elongated rods 36*a*, 36*b* or 536*a*, 536*b* mounted to slide through openings in the rear wall 30 or 530 and extending forwardly and rearwardly of the rear wall. The plungers are driven by the power devices 40 or 540 of the respective manually or pneumatically powered tools.

The cartridges are thus adapted to fit in the cartridge holding frame 11, with the nozzles or outlets extended through an open ended slot 35 in the front wall 28. The slot 35 is extended from near the center of the front wall generally along a plane through the centers of the spaced cartridges and/or plunger rods and in the direction normal to a plane through the end most pair 31 or 32 of straps and disposed centrally spaced between the strapes.

The front and rear walls of the cartridge frame can be rectangular in shape, the longer sides extending in the direction of separation of the side-by-side paired cartridges. The strap members 31, 32 lap over the edges of the longer sides of the front and rear walls. The front and rear walls need only have the longer sides extend beyond the center spacing of the two largest side-by-side paired cartridges to be used with the tool, so that the cartridges can project beyond the side edges of these walls (see FIGS. 3, 6, 9*a*, 9*b* and 9*c*). By contrast, the straps 31, or 32 will be closely adjacent the largest cartridge serving to retain such as positioned in the tool.

The tool front wall slot 35 is aligned with the side-by-side cartridges and is open-ended to receive the cartridge nozzles, and has side edges that cooperate with the cartridges for providing true axial alignment with the respective plungers and/or rods. The cooperating tool front plate and cartridges further serve to hold the cartridges in place within the tool as the plungers are rearwardly withdrawn from the empty cartridges.

The cartridges C1 are of a type having rigid tabs 77*a*, 77*b* extended laterally from the respective nozzle and generally parallel to the respective front closure wall 16*a*, 16*b* only slightly spaced forwardly therefrom. Specifically, the web portion 78 of the front plate adjacent and defining the slot 35 has a thickness approximately the same as or only slightly less that the spacing of tabs 77*a*, 77*b* from the respective front closure wall 16*a*, 16*b*. Thus, the cartridges are adapted to be positioned in the tool with said nozzles in the slot 35 and the front closure wall butted against the front wall spaced from the slot, and with the front closure wall and tabs snuggly straddling the front wall web portions 78 along the slot. The tabs 77*a*, 77*b* lie on the side of the front frame wall 28 remote from the rear frame wall 30, 530 and hold the cartridges in the tool, and can do so at any needed lateral positions along the slot to have the respective cartridge and plunger centers coincide.

The cartridges C2 are of a type having more widely separated adjacent cartridge nozzles 118*a*, 118*b*, and a separate one-piece cap 119 sealed over the cartridge nozzles. The nozzles and cap fit through the front wall slot 35, but the nut 90 holding the static mixing nozzle 19 relative to a common threaded outlet from the cap 119, is sized larger that the slot 35 and thereby overlies the front wall. However, the nut is much further spaced from the frame front wall 28 than it need or should be, providing for another aspect of this invention.

Specifically, the front wall is of greater thickness at most locations 94 than the thickness of the web portion 78 adjacent and defining the slot 35, while it nonetheless has spaced parallel front and rear faces and the slot web portions 28 are adjacent and form one of the faces. Thus, the slot web arrangement is off-set relative to the front wall faces and provides for the relocation of the effective axial separation between the rear frame wall 28, 528 and the front side of the front wall adjacent and defining the slot and remote from the rear wall, merely by repositioning the front wall with a half turn or flipped over orientation. The bolt mounting 33 for the straps-front wall allows the easy disassembly and reassembly between both front wall arrangements illustrated.

This front wall orientation is particularly suited for operation of said tool with cartridges of the C2 type, without any tabs, while allowing accurate axial cartridge-plunger alignments at any needed lateral positions along the slot and while having the static mixing nozzle tightening nut closley adjacent the remote side of the front wall adjacent the slot for securing the plunger fit and allowing easy rearward plunger withdrawal from the empty cartridges.

The plungers are sized to fit within the respective cartridges and against the wipers therein. For use with different size plungers, the plungers may be mounted on the plunger rod offset from its center, to fit within the respective cartridges and against the wipers therein, while yet not requiring any adjustment of the plunger rods relative to one another. Several possible flow and volumn ratio variations are illustrated in FIGS. 9*a*, 9*b* and 9*c*.

Figure 9A:
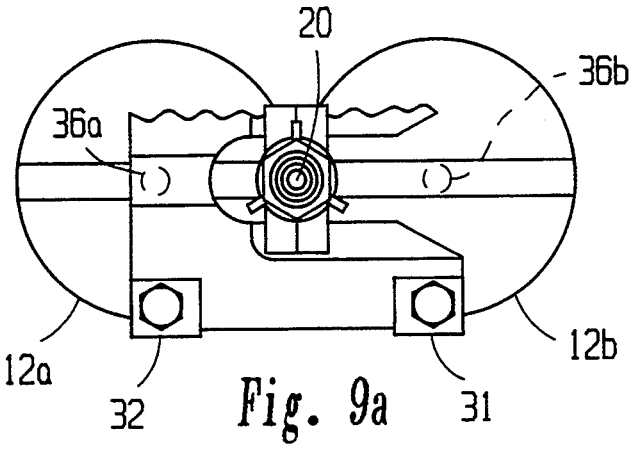
FIGS. 9*a*, 9*b* and 9*c* are frontal elevational views schmatically illustrating different cartridges varying in sizes and producing different component column ratios or rates as provided easily with the subject invention.
Figure 10:
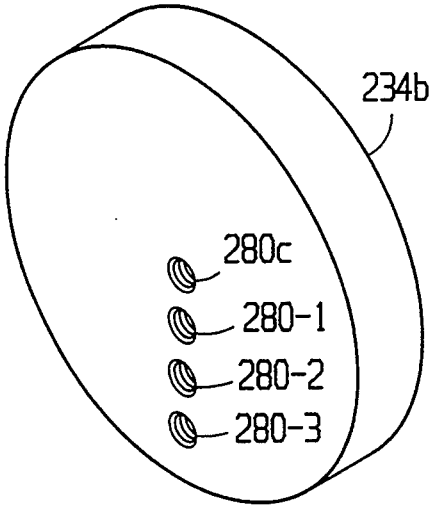
FIGS. 10 and 11 are perspective views, from the plunger rod side, of representative plungers having offset mounting holes for connection of such plungers to the plunger rods for use with different cartridge sizes.
Figure 9B:
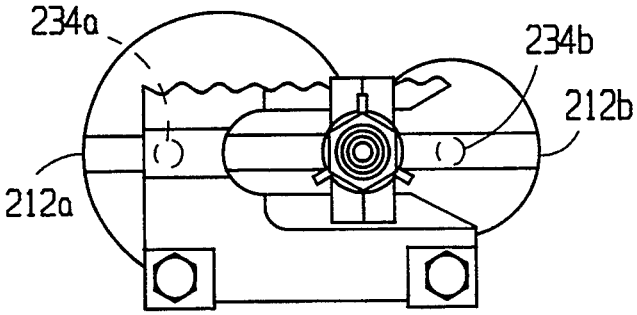
Figure 11:
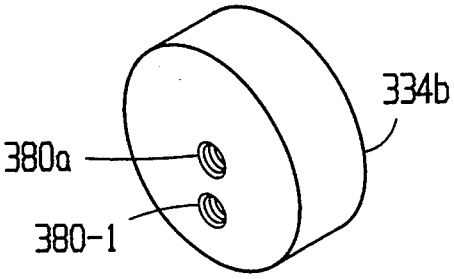
Figure 9C:
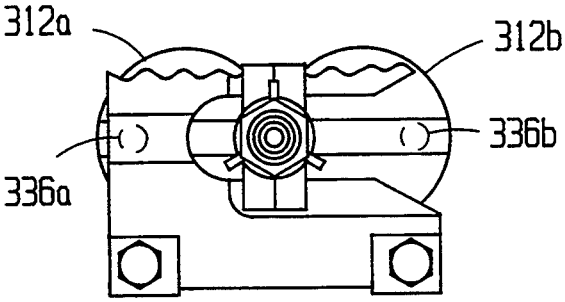
Figure 12:
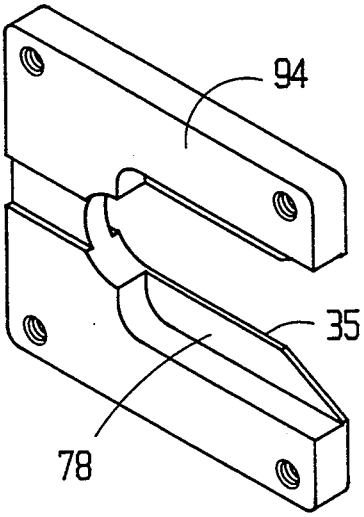
FIG. 12 is a frontal perspective view of the front wall used in the illustrated tools herein.

Specifically, FIG. 9*a* shows two equal diameter cartridges 12*a*, 12*b*, each being the largest possible size that can be assemblied in the tool, with the common outlet nozzle 20 being centered between the plunger rods and providing a 1:1 flow ratio. FIG. 9*b* shows two unequal diameter cartridges 212*a*, 212*b*, cartridge 212*a* being the largest possible size that can be assemblied in the tool and cartridge 212*b* being smaller. In this arragement, a non 1:1 ratio is achieved. A plunger 234*b* (FIG. 10) can be used with a centered tap 280*c* and several off-center taps 280-1, 280-2 and 280-3, whereupon the plunger rod 236*a* would be threaded into the proper offset tap as needed. As this is done, the common outlet 20 is shifted to an off-center spacing between the plunger rods 236*a* and 236*b*, while it yet is generally at the tangential meeting areas of the cartridges. FIG. 9*c* shows two equal diameter cartridges 312*a*, 312*b*, sized smaller than the largest possible but yet providing a 1:1 flow ratio. In this arragement, a plunger 334*b* (FIG. 11) can be used with a centered tap 380*c* and an off-center tap 380-1, whereupon each plunger rod 336*a*, 336*b* would be threaded into the offset tap 380-1 of its respective plunger.

Note that the operator can switch between the illustrated plunger arrangements, and others, merely by changeing the plungers, and without varying the spacing between the plunger rods, and while providing the preferred cooperation of the cartridge and front wall that maintains proper axial alignment of the plungers and cartridges. The front wall design allows for this convenience.

In the manually powered tool, the rear ends of the plunger rods are connected together by link 38, so that they can be moved axially only in unison substantially between the spaced walls 28, 30. A power ratchet device 40 is mounted over drive rod 37 rearwardly of the rear wall 30, having a stationary handle 41 and trigger 42 pivoted thereto. A drive member coupled to and actuated by the trigger 42 operates to shift the drive rod axially responsive to the actuation of the trigger.

The power device 40 is connected via spring linkage housed in case 51, link 38, and cartridge frame 11, to the front frame wall 28, as fully disclosed in the above-mentioned U.S. Pat. No. 5,314,092.

Operatively, upon squeezing the trigger 42, the drive rod 37 would be axially and incrementally indexed forwardly toward the front wall 28. In its minimum spring strain condition, the spring linkage would normally hold the drive and plunger rods solid relative to one another, to move the connected plungers 34*a*, 34*b* through the cartridges in unison with the forward movement of the drive rod. However, should the resistance against simultaneous plunger-cartridge movement exceed the minimum strain condition of the spring linkage, the spring linkage will change from being solid to being resilient. Thereafter, plunger-cartridge movement and resulting material discharge will be only under the bias of the spring linkage.

Repeated trigger activation will continue to index the drive rod, at the rate of trigger activation, which drive rod movement will be shared between actual plunger-cartridge movement and additional straining of the spring linkage beyond the minimum strain condition. This resilient driving action can continue until too slow trigger activation will allow the linkage to return to minimum strain conditions or too fast trigger activation could cause a maximum spring strain condition, again establishing a solid drive linkage holding the drive and plunger rods solid relative to one another. Thereafter, repeated trigger activation is then possible only at the rate allowed to provide in unison drive rod-power device and plunger-cartridge movements.

The spring linkage between minimum and maximum generated force conditions will be selected to provide a reasonably constant and uniform material discharge at an intended reliable rate, notwithstanding pauses between trigger activation or the like, which is particularly effective and needed in a multiple component materials system.

Figure 8A:
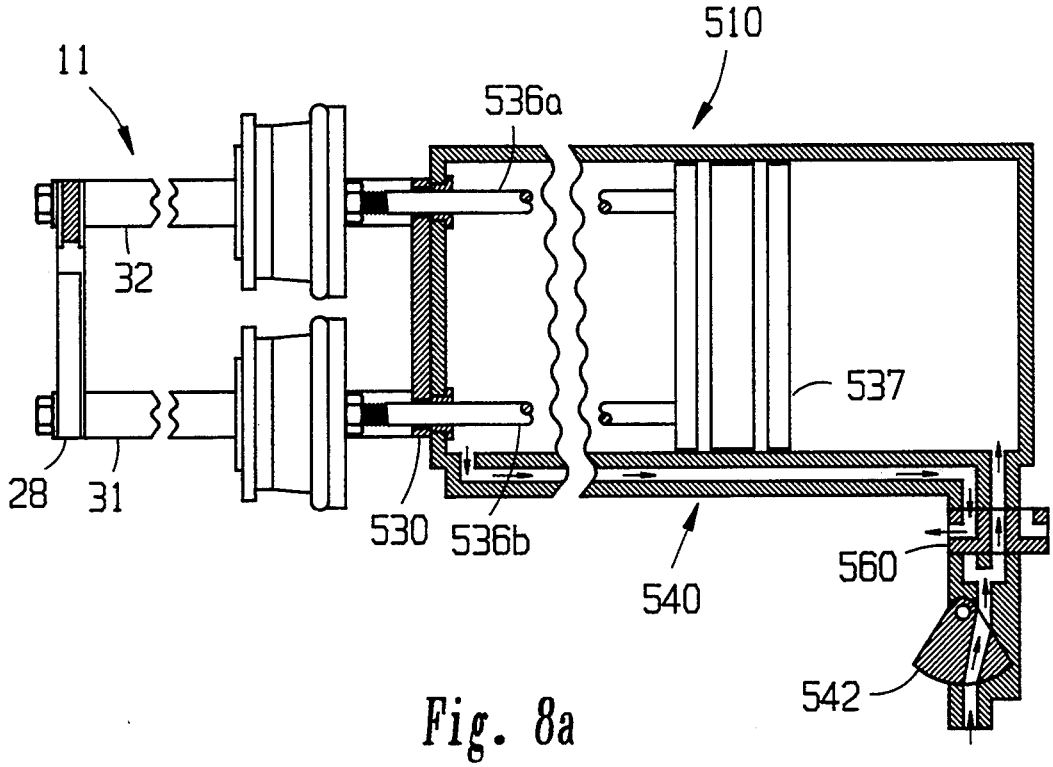
FIGS. 8*a* and 8*b* are sectional views, in operational schematic, of a pneumatic drive dispensing tool that can advantageously be used with the cartridges illustrated herein and others, and showing the front plate of FIG. 1 in the different operative positions as well as showing different size plungers.
Figure 8B:
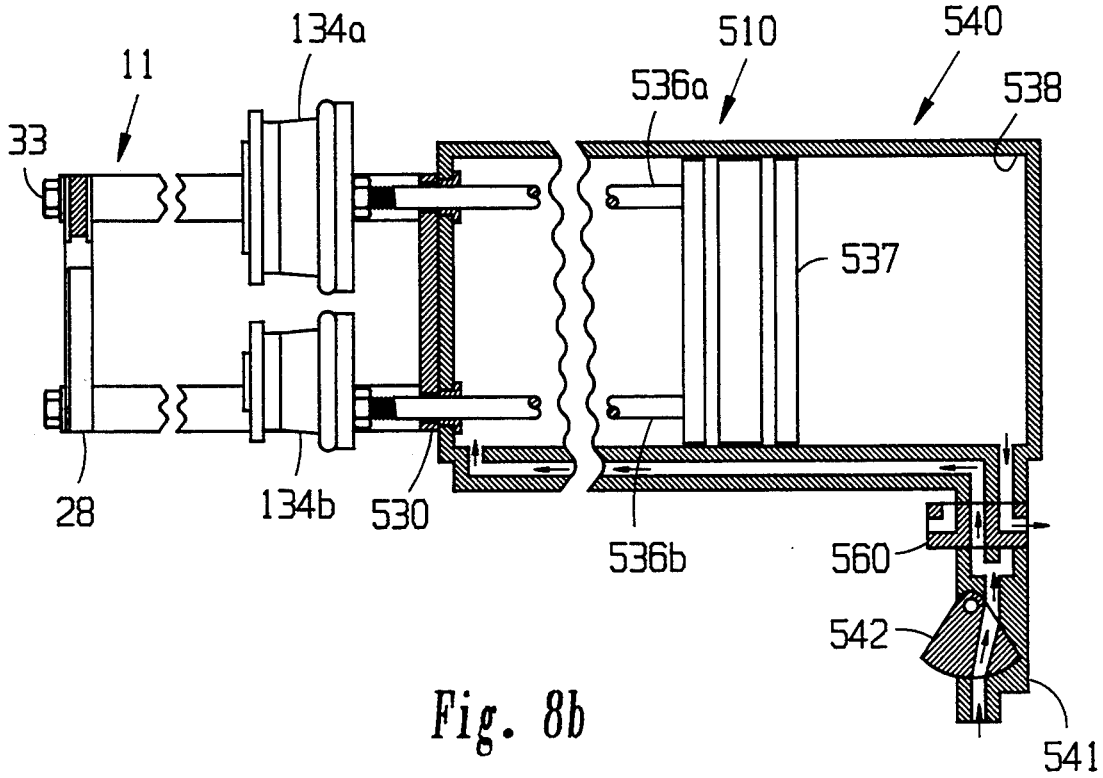

The dispensing tool 510 illustrated in FIGS. 8*a* and 8*b* is powered pneumatically and has a cylinder housing a piston and the plunger rods are secured to the piston and are extended through the front cylinder wall and the rear cartridge frame wall. Generally, the spacing between the plunger rods will be set to correspond to the intended separation of the paired cartridges, which in the tool at hand, would be the center line separation of the largest paired cartridges.

A conventional pneumatic power device 540 is illustrated on the dispensing tool 510 of FIGS. 8*a*, 8*b*, having a power cylinder 538 connected rearwardly of the rear wall 530. A stationary handle 541 is provided for support of the tool, and movable trigger 542 is pivoted thereto. The plunger rods 536*a*, 536*b* fit through openings in the rear frame wall and a power cylinder end wall, for connection to the piston 537 axially movable within the cylinder. Plungers are carried on each respective elongated rod 536*a*, 536*b* as noted. A shiftable forward-reverse valve 560 provides, when shifted, for moving the piston forwardly toward the front wall or rearwardly away from the front wall. Plunger advances through the cartridges will only be in unison.

Incidental variations of the invention can be made without departing from the inventive concept, so that the invention should be limited only by the scope of the following claims.

What is claimed as our invention is:

1. A tool for dispensing material from a multiple component reactive materials system having paired tubular cartridges each having a front closure wall with a nozzle and having an open rear end, and a wiper slidable within the cartridge and closing the open end thereof, and a static mixing nozzle sealed over the cartridge nozzles by means including a tightening nut and having a common outlet for the mixed cartridge materials, the cartridges being conventional and usable in varying relative sizes and shapes, comprising the combination of the tool having a cartridge frame formed of a front wall, a rear wall, and two pairs of two straps each between the walls, the axial spacing between the front and rear walls slightly exceeding the length of the cartridges, and the lateral spacing between each pair of two adjacent straps slightly exceeding the diameter of largest cartridge useable with the tool;

a plunger for each cartridge, each plunger having a rigid body sized to fit within the open end of the respective cartridge end and against the wiper, and spaced parallel rods extended through respective openings in the rear wall for supporting the respective plungers for axial movement between the front and rear walls;

said front wall having an open ended slot extended from near the center of the front wall generally along a plane through the spaced rods and in the direction normal to a plane through one pair of the straps and disposed centrally spaced therebetween, and the portion of the front wall adjacent and defining the slot having a given thickness;

means for mounting the front wall in two different arrangements, where in each mounting arrangement the axial separation between the rear wall and a near side of the front wall spaced from the slot is substantially the same, and where in one mounting arrangement the axial separation between the rear wall and the remote side of the front wall adjacent and defining the slot is less than in the other mounting arrangement;

said one mounting arrangement being suited for cartridges having rigid tabs extended laterally from the respective nozzle and generally parallel to the respective front closure wall only slightly spaced forwardly therefrom by approximately the thickness of the portion of the front wall defining the slot, and said cartridges being adapted to be positioned in the tool with said nozzles in the slot and the front closure wall butted against the near side of the front wall spaced from the slot and the tabs being on and butted against the remote side of the front wall adjacent and defining the slot, for rearward plunger withdrawal from the cartridges and for holding the cartridges in the tool at any needed positions along the slot to have the respective cartridge and plunger centers coincide; and said other mounting arrangement being suited for cartridges not having laterally extended rigid tabs, said cartridges being adapted to be positioned in the tool with said nozzles in the slot and the front closure wall butted against the front wall spaced from the slot and said static mixing nozzle tightening nut butted against the remote side of the front wall along the slot, for rearward plunger withdrawal from the cartridges and for holding the cartridges in the tool at any needed positions along the slot to have the respective cartridge and plunger centers coincide.

2. A dispensing tool according to claim 1, further providing the front wall having different thicknesses, being greater in areas other than at the portion thereof defining the slot and the slot portion and other areas being offset, to allow said modification of the axial separations between the rear wall and the remote side of the front wall adjacent and defining the slot in the two mounting arrangement being effected merely by repositioning the front wall in a half turn flipped over orientation.

3. A dispensing tool according to claim 2, further wherein the means for mounting the front wall in two different arrangements includes removable bolt mountings between the straps and front wall, for allowing the disassembly and repositioning of the front wall.

4. A tool for dispensing material from a multiple component reactive materials system having paired tubular cartridges each having a front closure wall with a nozzle and having an open rear end, and a wiper slidable within the cartridge and closing the open end thereof, and a static mixing nozzle sealed over the cartridge nozzles by means including a tightening nut and having a common outlet for the mixed cartridge materials, the cartridges being conventional and usable in varying relative sizes and shapes, comprising the combination of the tool having a cartridge frame formed of a front wall, a rear wall, and two pairs of two straps each between the walls, the axial spacing between the front and rear walls slightly exceeding the length of the cartridges and the lateral spacing between each pair of paired adjacent straps slightly exceeding the diameter of the largest cartridge useable with the tool, to allow such cartridges to fit between the walls and paired adjacent straps;

said front wall having an open ended slot extended from near the center of the front wall generally in the direction normal to a plane through one pair of the adjacent straps and disposed centrally spaced therebetween;

said cartridges being adapted to be positioned in the tool with said nozzles in the slot and the front closure wall butted against the front frame wall, each of the paired cartridges being spaced apart a specific center-to-center distance, but the center-to-center distances of different paired cartridges potentially being different;

a plunger for each cartridge, each plunger having a rigid body sized to fit within the open end of the respective cartridge end and against the wiper;

spaced parallel plunger rods extended through respective openings in the rear wall, for supporting and for axially moving the respective plungers between the front and rear walls, the parallel plunger rods being a fixed distance apart and parallel to the properly positioned cartridge centers; and each plunger having different mounts for connection to its rod, comprising a centered mount and an offset mount corresponding to the offset between the plunger rod and cartridge center, allowing alternative appropriate rod-plunger connections to suit specific variations of cartridge sizes and ratios, while having the respective cartridge centers shifted along the front plate slot as needed and yet having parallel cartridge and plunger centers and the respective cartridge and plunger centers coincide, and without varying the spacing between the plunger rods.

5. A dispensing tool according to claim 4, further providing means for mounting the front wall in two different arrangements, where in each mounting arrangement the axial separation between the rear wall and a near side of the front wall spaced from the slot is substantially the same, and where in one mounting arrangement the axial separation between the rear wall and the remote side of the front wall adjacent and defining the slot is less than in the other mounting arrangement, suited in one arrangement for cartridges having rigid tabs extended laterally from the respective nozzle whereby the tabs butt against the remote side of the front wall adjacent and defining the slot, and suited in the other mounting arrangement for cartridges whereby the static mixing nozzle tightening nut butt against the remote side of the front wall along the slot, each arrangement allowing rearward plunger withdrawal from the emptied cartridges and holding the cartridges in the tool at any needed positions along the slot to have the respective cartridge and plunger centers coincide.

6. A dispensing tool according to claim 5, further providing the front wall having different thicknesses, being greater in areas other than at the portion thereof defining the slot and the slot portion and other areas being offset, to allow the two mounting arrangement merely by repositioning the front wall in a half turn flipped over orientation.

* * * * *